US006227010B1

(12) United States Patent
Roell

(10) Patent No.: US 6,227,010 B1
(45) Date of Patent: May 8, 2001

(54) ELASTIC MULTI-LAYERED KNITTED ARTICLE

(75) Inventor: Friedrich Roell, Biberach (DE)

(73) Assignee: Recaro GmbH & Co., Kirchheim-Teck (DE)

( * ) Notice: Subject to any disclaimer, the term of this patent is extended or adjusted under 35 U.S.C. 154(b) by 0 days.

(21) Appl. No.: 09/254,216

(22) PCT Filed: Sep. 2, 1997

(86) PCT No.: PCT/DE97/01929

§ 371 Date: Mar. 2, 1999

§ 102(e) Date: Mar. 2, 1999

(87) PCT Pub. No.: WO98/10127

PCT Pub. Date: Mar. 12, 1998

(30) Foreign Application Priority Data

Sep. 5, 1996 (DE) ..... 196 36 208

(51) Int. Cl.[7] ..... D04B 15/00
(52) U.S. Cl. ..... 66/170; 66/64
(58) Field of Search ..... 66/169 R, 170–190, 66/196–198, 202, 64, 75.1; 442/304, 312, 318; 5/653; 297/218.1

(56) References Cited

U.S. PATENT DOCUMENTS 4,062,204 12/1977 Segundo et al. .
5,209,084 * 5/1993 Robinson et al. ..... 66/196
5,255,538 * 10/1993 Day et al. ..... 66/196
5,267,454 * 12/1993 Gregory ..... 66/196
5,284,031 * 2/1994 Stoll et al. ..... 66/196
5,379,612 * 1/1995 Stoll et al. ..... 66/196
5,465,594 11/1995 Imboden et al. .
5,711,169 * 1/1998 Leeke et al. ..... 66/196
5,887,452 * 3/1999 Smith et al. ..... 66/196

FOREIGN PATENT DOCUMENTS 27 13 539 9/1978 (DE) .
2 263 325 10/1975 (FR) .
2 263 286 7/1993 (GB) .

* cited by examiner

*Primary Examiner*—Danny Worrell
(74) *Attorney, Agent, or Firm*—Smith-Hill and Bedell

(57) ABSTRACT

The present invention relates to a method for fabricating a—more particularly multi-ply—knit having definably variable transverse stability and transverse elasticity including a basic weave in at least one ply of the knit, the basic weave comprising a succession of first courses in which most of the active needles are used in forming a loop and second courses predominantly comprising floats having a spacing length of at least two active needles, successive sequences of first and second courses being selected in keeping with the requirements as to the transverse elasticity and transverse stability of the knit, whereby the proportion of the first courses in the more elastic knit portions is higher than in the transverse stable portions of the knit.

38 Claims, 4 Drawing Sheets

ELASTIC MULTI-LAYERED KNITTED ARTICLE

The present invention relates to a single- or multi-ply knit featuring high stability, variable pattern and design, defined elasticity, it also relating to a method of fabricating same.

Such knits are conceived more particularly for applications requiring, on the one hand, the ability to withstand heavy loads and, on the other, featuring a defined elasticity, one preferred application being seating furniture. Hitherto the technical construction of seating furniture employing textiles as the seating surface area included the use of a frame in which a—usually woven—textile is fixed in place laterally by springs. The textile—woven predominantly rigid for this purpose—features a high loading capability and the elasticity was achieved by joining the textiles to the frame by means of springs.

In conjunction with the conception of novel coverings the trend is to do away with the use of springs since these tend to spoil the pleasing appearance of seating furniture. Furthermore, there is always the risk, when using springs, of lighter items of clothing becoming snared in the springs or spring suspension system. On the other hand, the rigid fabric adapts to the shape of the seated person only with restrictions whilst failing to offer support at important locations such as e.g. in the lordotic region.

It is thus the object of the present invention to define a method of fabricating a mechanically stable knit featuring not only high mechanical strength but also enabling its elasticity and design to be varied in differing portions by making use of differing, more particularly, elastic materials.

In a first method for fabricating a—more particularly multi-ply—knit having definably variable transverse stability and transverse elasticity the work is done with a basic weave in at least one ply of the knit, this basic weave containing courses comprising predominantly floats having a spacing length of at least two active needles mutually staggered in sequential courses, in which case the transverse stability may be engineered by varying the float length and additionally, where necessary, by using more or less elastic materials in differing portions of the knit.

In a second method in accordance with the invention for fabricating a—more particularly multi-ply—knit having definably variable transverse stability and transverse elasticity a basic weave is used in at least one ply of the knit, this basic weave comprising a sequence of first and second courses, whereby in the first courses most of the active needles are used in forming a loop and in the second courses floats are formed predominantly having a spacing length of at least two active needles. By suitably selecting successive sequences of first and second courses in keeping with the requirements as to the elasticity and transverse stability of the knit, portions partially differing in elasticity and stability may be engineered in the knit. In the more elastic transverse portions of the knit the proportion of the first courses involved is higher than in the transverse stable portions of the knit. In this respect it is to be noted that transverse elasticity or transverse stability identifies the direction of the needle bed. The stability may be regulated not only by the sequence of the first and second courses but also by the length of the floats, i.e. the longer the float the higher the transverse stability with a reduction in the longitudinal stability, which may be increased, however, for example, by including a warp thread.

Preferably the knit contains a basic weave with at least two knit plies preferably produced separately on at least one front and one rear needle bed of a flat bed machine. Each ply contains an alternating succession of first courses, in which with at least the majority of the active needles a loop is formed and second courses in which floats are configured. The floats are produced by knitting with every second active needle at the most so that the resulting floats have at least the length of the spacing of the two active needles. Preferably the first courses are knitted with at least all active needles more or less.

Whilst an elasticity typical of knits is exhibited by the looped first courses the second courses ensure a higher transverse stability, i.e. a stability in the needle bed direction or in the direction of the courses, this stability being all the more the longer the floats and the denser the succession of the second courses in the basic weave. On the other hand, with increasing float length the longitudinal stability also increases, i.e. the stability in the direction of the wales. Here, however, the strength in the longitudinal and transverse direction may also be increased by selectively including warp and/or weft threads.

By selecting the succession and number of the first and second courses, e.g. a first course followed by two second courses or two first courses followed by a second course or alternating the succession of a first and second course in each case the desired quality of the knit—either higher elasticity or higher transverse stability—may be engineered as desired individually, more particularly also partially and by the selection of differing materials. As already discussed, this may also be engineered by the length of the floats in the second courses.

Preferably an alternating arrangement of four courses is employed in the basic weave. The first two courses have already been described in advance. Adjoining the second course is a third course formed in the same way as the first course. Following the third course is a fourth course which is in turn formed in the same way as the second course, except that the floats of the fourth course are staggered relative to the floats of the second course. It is in this way that the overall stability of the knit is enhanced.

The two knit plies are mostly knitted separately on a front and a rear needle bed, i.e. ultimately two separate plies are knitted which may be knitted or otherwise joined to each other at their borders. It is in this way that a kind of large hose—or also any other kind of contour—is produced which then merely needs to be tensioned on a frame , thus doing away with the need of an arrangement of separate fasteners on the knit which, however, may also be provided additionally or alternatively.

In one very stable structure the floats too, of the second and first courses are mutually staggered in the two plies located one on the other which in turn, like the staggered arrangement of bricks in a wall, positively influence the overall stability of the knit.

The two plies of the basic weave may also be joined to each other by a pile thread or by other jointing techniques, as a result of which the thickness of the knit and others parameters such as e.g. its strength may be further influenced.

It is preferably in portions in which higher elasticity is to be provided that one or more further knit weaves may be provided, e.g. in the form of a net weave, within which the two plies of the basic structure are joined to each other in such a way that a netlike structure materializes of high strength, which is also highly elastic and strongly perforated, however. It is in these portions too, that the elasticity and strength may be engineered by suitably selecting the knit weave and the materials employed. In seating furniture this structure is preferably to be provided in the back portion which needs to ensure good "breathing" performance in addition to the required elasticity. This net weave is characterized by a joined single- or multi-ply structure in which in the first courses a loop is formed at each active needle, the looping threads, however, being tucked on the needles of at least one second needle bed in defined needle spacings. In one or more subsequent second courses separate floats are formed on the first needle bed, these floats being preferably mutually staggered in several second courses in sequence. In the subsequent third course a structure of the first course is again knitted. In the fourth course in conclusion the tuck is transferred back from the needles of the second bed to the first needle bed, as a result of which the holes materialize in the net structure. These four courses are knitted successively to produce the net structure. The mesh of the net structure may be engineered as required by spacing the tucks on the second needle bed accordingly and by repeating the second courses where necessary. But, of course, the net structure may be engineered via other parameters such as e.g. by suitably selecting the needles, the spacing of the applied tucks and the transferred needles accordingly. It is usually so that larger holes are produced by simple loop covering/transfer. To stabilize the structure a weft thread may be included especially in the region of the hole rims. Placing and including floats optionally serves purely to stabilize the stability without influencing the appearance to any appreciable extent. In addition, to boost the stability between both plies a pile thread may be provided.

By combining the basic structure with the net structure the knit may also be stuctured as desired. Furthermore, by engineering the net structure in the basic structure at specific locations, e.g. in the seating or back portion of seat furniture, portions may be provided which are more elastic and perforated. By defining the joint of the basic structure to supplementary knit weaves—especially also partially/sequentially—preferably differing net structures having differing (loop) strengths and rigid or elastic materials may be produced in achieving seat coverings which are bodily accommodating, self-supporting and more particularly patterned.

The knit structures as discussed above are excellently suited for producing a self-supporting, structured seat cover, the self-supporting knit coverage taking into account the requirements on both the mechanical properties as well as the appearance due to the configuration being aesthetically shaped and optionally structurable. It is in this way that both the stability properties as well as the seating comfort may be realized, hitherto having been held to be impossible. Such a seating element produced from the knit as described above may be fabricated as a two-, two and a half- or three-dimensional structure. It will readily be appreciated, of course, that the knit may be secured to the frame, particularly in the edge portion, by additionally fasteners. Preferably, however, the hose-shaped structure is to be selected in which no separate fasteners need to be provided between the knit and the supporting tubular frame.

The invention will now be described by way of an example with reference to the schematic drawing in which.

Figure 1:
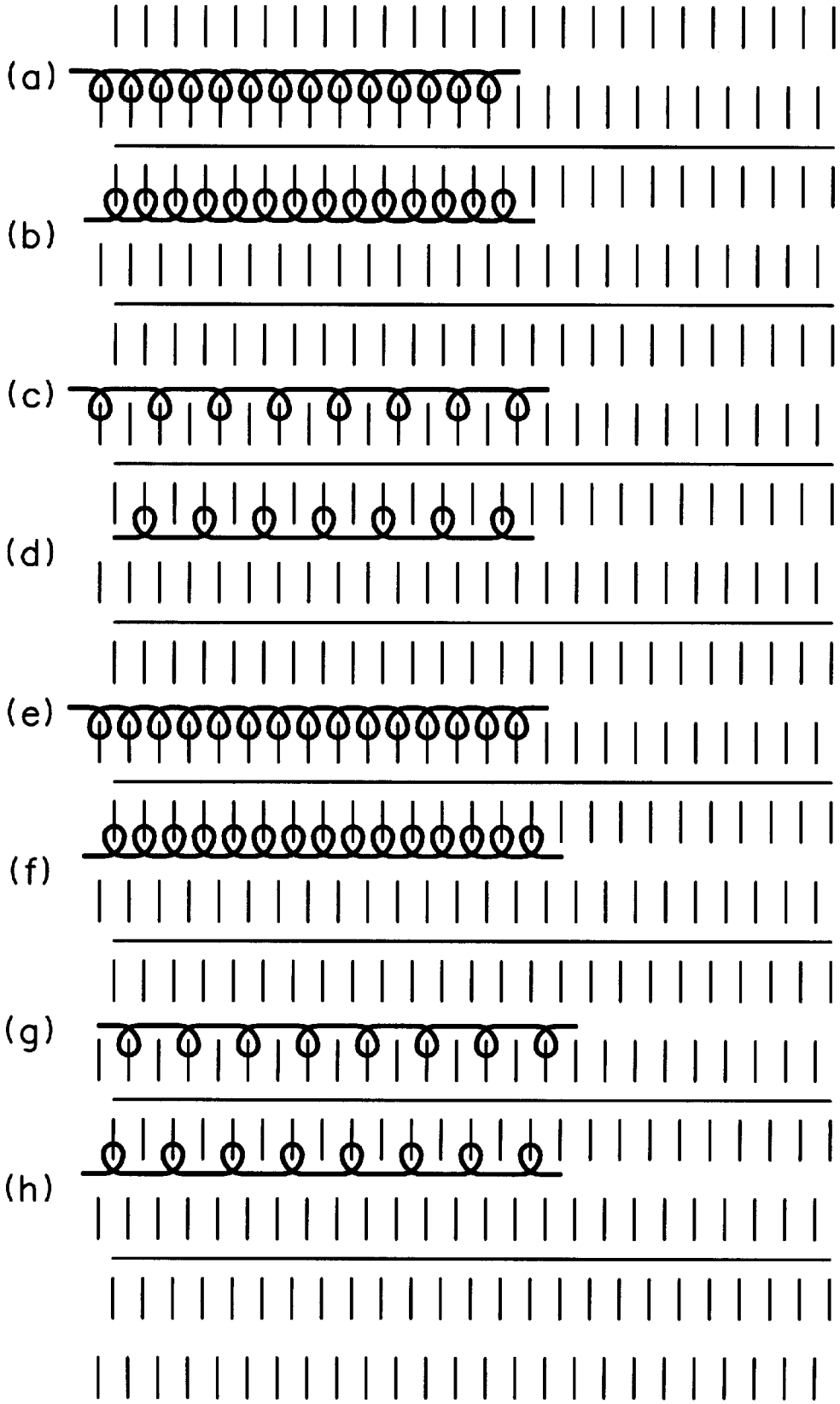
FIG. 1 is a needle diagram of a basic weave of the knit in accordance with the invention.

Referring now to FIG. 1 there is illustrated the basic weave of a knit of the present invention.

As evident from FIG. 1*a*) loops are formed on the needles of the front needle bed, i.e. one loop being formed on each active needle. In the same course one loop each is formed on each active needle—likewise as evident from FIG. 1*b*)—of the rear needle bed, FIGS. 1*c*) and *d*) then showing the formation of the second course. As evident from FIG. 1*c*) floats are formed on the front needle bed, by the loop thread being sunk on every second needle. Of course, as an alternative, the loop thread may also be sunk on every third, fourth, etc. needle. It is furthermore possible to form the float not by sinking the thread at joining points, but by tucking. In the same way, as evident from FIG. 1*d*) the floats are formed on the rear needle bed staggered relative to the floats on the front needle bed. These floats as evident from FIGS. 1*c*) and 1*d*) endow enhanced stability in the longitudinal direction of the needle bed depending on the selected length and the sequence in the knit of the basic weave. In the steps e) and f) of the method a loop is formed on each active needle in turn firstly on the front and then on the rear needle bed. In Figs. g) and h) it is in turn evident how floats are generated in a fourth course by in turn the loop thread being joined only to every second, fourth, sixth, eighth, tenth etc. active needle. It is to be noted in particular that the floats as produced in steps g) and h) of the method in the fourth course are staggered relative to the floats in steps c) and d) in the second course by one needle position in each case. It will readily be understood that sequencing loops and floats may be selected at will, e.g. the first or third courses in accordance with steps a), b) or e), f) of the method may be formed twice in sequence and/or floats in accordance with steps c) and d) or g) and h) may be formed several times in sequence, i.e. in several courses in sequence. By suitably selecting this succession and the float lengths in steps c), d) and g) and h) of the method the elasticity or stability of the knit may be engineered as desired. If the floats in accordance with step c), d) and g) and h) are not sunk, they instead simply being tucked, the stability may be enhanced even further. The basic structure may also be produced solely by staggering the floats as evident from steps c+d, g+h.

Figure 2:
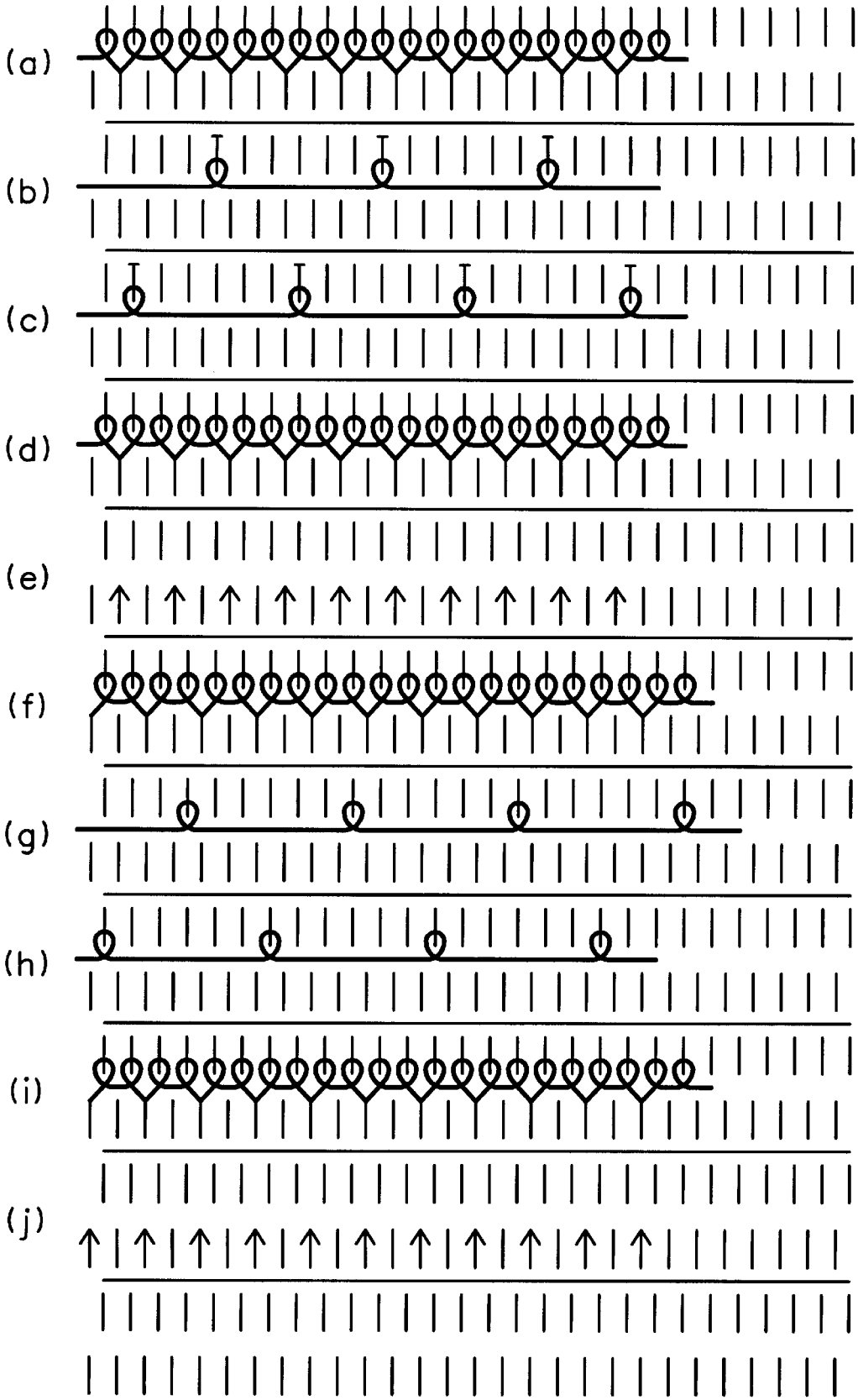
FIG. 2 is a needle diagram of a net weave of the knit in accordance with the invention.
Figure 3:
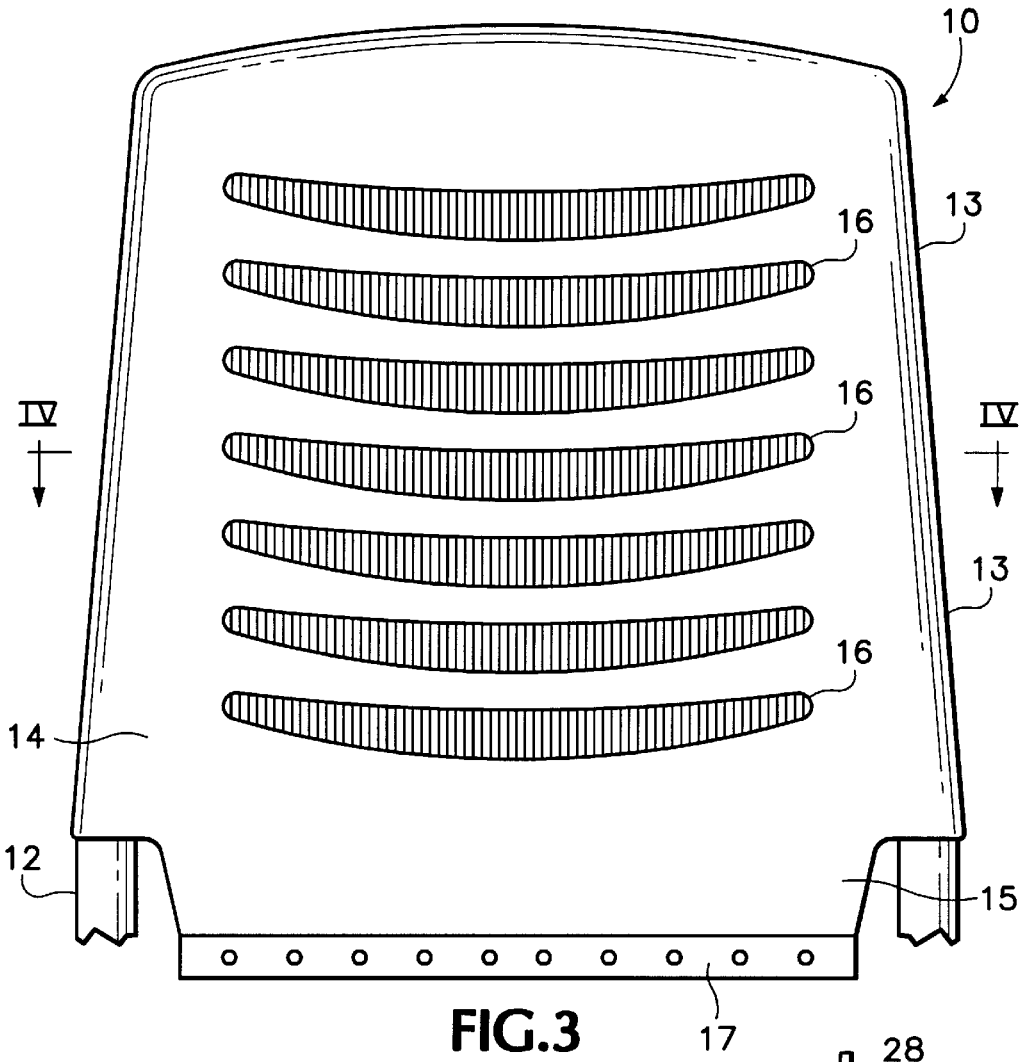
FIG. 3 illustrates application of the basic weave and net structure in the backrest of a seating furniture.

Referring now to FIG. 2 there is illustrated the needle diagram for the net weave which may be included in the basic weave in the way as shown in FIG. 3. The net weave achieves a structure which is strongly perforated and more elastic than the basic weave, exhibiting primarily high stability and serving as a supporting structure, the net weave in this case being a joined two-sided structure.

In a first course as evident from FIG. 2*a* sinking is done on each active needle of the rear needle bed whilst the loop thread is tucked on needles of the front needle bed on defined spacings, in this case on a two needle spacing. Subsequent floats are knitted in a second and third course, which may be considered as being a succession of two second courses, on the rear needle bed, these floats extending over the length of six needles in each case and the floats of the second and third course being mutually staggered roughly in unity. In a fourth course as shown in FIG. 2*d* the step in the method as evident from FIG. 2*a* is repeated and the tuck is transferred back in the subsequent fifth course as evident from FIG. 2*e*. In the steps in the method f) to k) forming these fifth courses is repeated, the floats of the seventh and eighth course being in turn staggered relative to the floats in the second and third course as per b) and c) in the steps g) and h) of the method. Transferring the tucks from the front needle bed back to the rear needle bed according to the steps e) and k) of the method. However, placing the tucks, selecting the needles, length and including the floats and transferring the needles or tucks may also be selected individually.

Referring now to FIG. 3 there is illustrated a backrest of a seat cover 10 tensioned on a tubular frame 12. The cover in a dual-ply weave may be knitted single-bedded or doubled-bedded. The tubular frame 12 consists preferably of a painted or chromed tube of steel or some other refined metal, plastics, light-alloy or composite material thereof. The seat cover 10 is configured in the total base portion 14, especially in the portion for attachment, by the basic weave as shown in FIG. 1. In the backrest portion several net portions 16 are provided knitted with the net weave. It is in these net portions 16 that the elasticity is enhanced due to the weave character of the net weave. In addition, the knit in these net portions 16 is heavily perforated so that the corresponding passage of the back is well ventilated. By employing these portions 16 with other weave techniques intarsia patterns of variable design may be produced. The seat cover 10 is thus pleasing in appearance whilst featuring high functionality. The edge portion 13 of the cover is worked with rubber threads, as a result of which the stepped structure as usual in curved or semicircular shapes—in the upper edge portion as illustrated—is neatly concealed. The edge portion knitted with a rubber thread also serves to absorb sudden high stresses in the cover, thus enabling edge portions to be configured insensitive to shock loads. In the lower concluding portion of the cover a reinforced hole strip or border 17 may be integrated for fixing the cover to a cross strut. Achieving an improved weave of the cover to the hole border 17 is possible by employing fusible threads, thus enabling the knit structure to be fused in the region of the hole border when clamping the cover in place between two heated hole border parts so that no overloading of individual loops or loop portions occurs in the region of the holes. The portion 15 between hole border 17 and frame 12 is preferably loop-stitched or likewise knitted with fusible threads so that a neat, tough finish is achieved due to the fusing of the knit structure when this portion 15 is subsequently heated.

Worked into the lower edge of the cover is a fixing strip.

Figure 4:
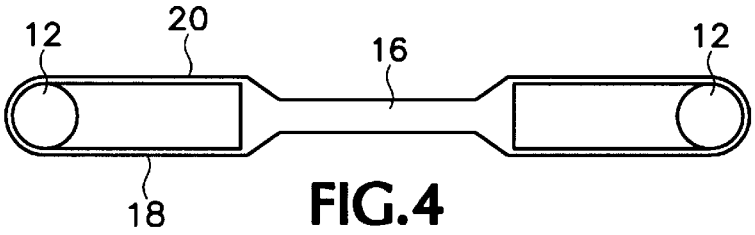
FIG. 4 is a cross-section IV—IV through the backrest as shown in FIG. 3.

Referring now to FIG. 4 there is illustrated the cross-section IV—IV taken from FIG. 3 from which it is clearly evident that the basic weave consisting of the two plies 18 and 20 in the base portion 14 is tensioned between the tubes 12 of the chair frame. Likewise clearly evident is that the two plies 18, 20 of the basic weave are joined to each other in the region of the net weave 16, this net portion 16 ensuring corresponding ventilation of the backrest surface area.

Figure 5A:
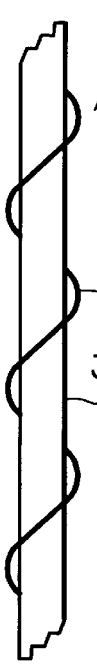
FIG. 5A illustrates the structure of a thread that may be used in an edge portion of the backrest shown in FIG. 3.
Figure 5B:
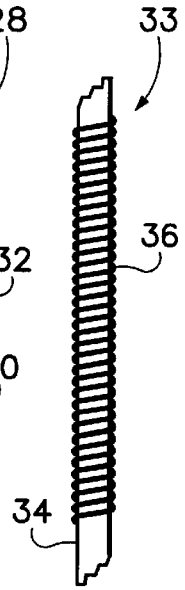
FIG. 5B illustrates the structure of another thread that may be used in the backrest shown in FIG. 3.

Referring now to FIG. 5 threads are illustrated as may be used in the edge portions 13, 15 of the cover. The thread 28 as evident from FIG. 5*a*) has a PES/PA base 30 and is wrapped by a thermal thread 32 of defined shrinkage. Heating the portion 15 knitted with such a thread 28 causes the knit to contract in a defined manner, it thereby slightly fusing, where necessary, so that good accommodation to the frame 12 or a defined tension in the corresponding portion 15 with a smooth finish is achieved. FIG. 5*b*) shows an elastic thread 33 with a PES/PA base thread 34 wrapped by a rubber thread 36, this kind of thread too, enabling a good seating of the cover on the frame and concealment of the curved stepped portions (upper rest edge) to be achieved. By using this thread in the frame portion 13 a portion knitted with this thread 22 also has shock-absorbing properties.

Figure 6:
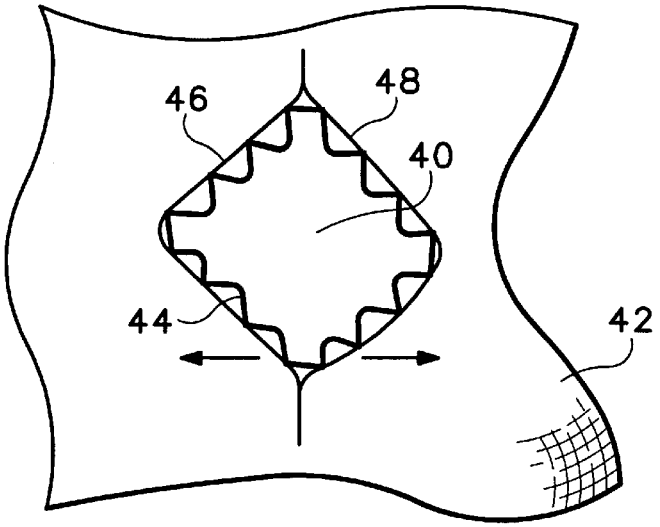
FIG. 6 illustrates formation of a hole in a net structure.

Referring now to FIG. 6 there is illustrated how a hole 40 is produced in a net structure 42. The hole is generated by transferring loops 44 outwardly as indicated by the arrows with subsequent interknitting of the loops. In the edge portion of the hole two warp threads 46, 48 are introduced endowing the hole with good stability. It is in this way that also stable net structures may be produced with large holes which are pleasing in appearance and ensure good ventilation for an application in seat covers.

Figure 7:
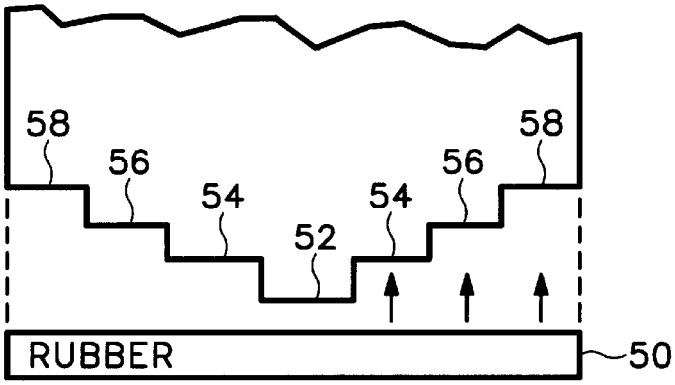
FIG. 7 illustrates how curved edges may be knit.

Referring now to FIG. 7 there is illustrated a method of neatly knitting curved edges, one or more courses of rubber threads being knitted for this purpose. Subsequently the resulting rubberized strip 50 is joined stepwise to portions knitted with normal threads. Firstly, a central section 52 is knitted to the strip 50, the central section having a height of one or more courses. Then the adjoining portions 54 are additionally knitted, again over one or more courses. This adjoining knitted portion extends over the portions 56 and 58 until the strip 50 is further knitted with a normal thread over the full width. The result is a smooth, neat curved edge which accommodates elastically to the frame by using the rubber thread, e.g. 33 as shown in FIG. 5.

Figure 8:
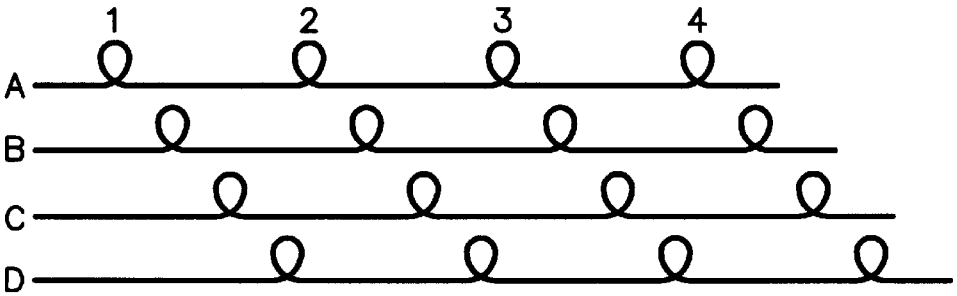
FIG. 8 illustrates a detail of the basic weave with staggered floats.

Referring now to FIG. 8 there is illustrated a detail of the basic weave four courses (A to D) long and four loops (1 to 4) wide. The courses A to D of this basic weave contain staggered floats interlooped at the points 1 to 4 at which they may also be tucked. By selecting differing thread materials and differing float length the elasticity or stability properties of the basic weave may be individualized in each course A to D and at all points of interlooping 1 to 4.

FIGS. 3 and 4 make it clear that definably varying the elasticity or stability of the knit at differing points is possible not only by the way in which the basic weave and net weave as such are engineered, but that making this selection may be furthermore supported by specifying the arrangement of the net portions 16 within the basic weave portions 14. In this respect too, the high functionality of the arrangement of these portions is combinable with a corresponding decorative effect.

It will be appreciated that the invention is not restricted to the embodiments as described. Thus, for instance, the first (front) ply may be joined to the second (rear) ply by inserted/interwoven pile threads. To stabilize the knit longitudinally (in the direction of the wales) or crosswise, warp/weft threads—especially of high-strength materials—may also be inserted/interwoven partially/sequentially.

The first ply may be worked independently of the second ply with different structures and materials, whereby, of course, the plies may also be worked partially with different structures, various materials or hybrids thereof—more particularly of the elastic or shrink-type—or with various weave structures. When using shrink-type textile threads the knit is first tensioned on the frame and then shrunk so that the knit accommodates to the frame pleasing in appearance, where necessary in avoiding the formation of steps or staircasing.

Any steps/jags materializing in the border portion due to reduction/increase may also be concealed by employing elastic materials, the rubber thread loop serving in the horizontal/vertical border portion as a shock absorber.

In addition to various net structures other weaves having similar properties may also be integrated.

A stable hole border as a concluding feature serves to fix and tension the cover in the direction of the wales, whereby, of course, also other fasteners may be directly integrated.

On a four-bed machine a stable hose cover may be fabricated from two-sided knit plies with the advantage that the desired stability/elasticity is now achievable by differing weave structures simpler, cheaper and longer lasting.

Twinned knitting offers more particularly the simple possibility of working the more stable passages with a+b needles, the stretchable passages with only the a needles.

Large net holes may be achieved more particularly also by loop transfer, an additional thread being interwoven to stabilize the edge portion.

In addition to employing differing net structures or weaves having similar properties patterns may also be worked to high effect in the known intarsia technique, these elements then consisting preferably of elastic materials.

The automatically open borders are loop stitched or sealed by a fusible thread.

A hose cover may also be produced in using elastic materials, this hose cover then being stretched over a core of expanded plastics material.

The basic weave just like the net structure or weave structure may be defined in elasticity and stability by a differing combination of all or only selected needles and/or elastic threads and/or floats respectively.

In elastic portions loops or warp and weft threads may be produced or integrated defined by elastic threads having a defined stretch, it being in this way that a specific tension may be defined in a knitted cover or border areas worked so that they neatly accommodate to the frame.

Preferably the knit of a seat cover is structured multi-ply. In achieving curved, cylindrically convex or concave shapings of the knit the various plies may be knitted with a differing number of loops and/or wales.

Preferably a seat is produced with a cover consisting of a multi-ply structure, the plies then being assigned to advantage differing functions. Thus, for instance, a lower ply may be configured as a supporting ply whilst a seating ply oriented in the direction of the seating surface area may be engineered for a climatic function, e.g. with perforated portions or moisture-absorbing properties, whereby these plies may be interknitted or also interwoven by a pile thread.

In one embodiment of the invention a seat is provided with a cover produced from an elastic hose knit. This elastic hose knit is stretched over the frame thus automatically accommodating itself thereto, the materials used therefor possible being Elasthan or material hybrids.

What is claimed is:

1. A method of making a knit employing a flat bed machine having front and rear needle beds with active needles, the method including forming a basic knit of at least one ply by knitting a succession of courses including floats, wherein each float has a spacing length of at least two active needles, the floats in an earlier course are staggered with respect to the floats in a later course, and the spacing length of the floats varies within the knit.

2. A method according to claim 1, comprising including warp threads in the basic knit to increase longitudinal stability of the basic knit.

3. A method according to claim 1, wherein said one ply is composed of said basic knit and at least one other knit.

4. A method according to claim 1, wherein the basic knit is of at least two plies and the method comprises providing a pile thread between the two plies of the basic knit and joined alternatingly to the two plies in defined spacings by loop sinking or tucking.

5. A method according to claim 1, wherein the basic knit is of at least two plies and the floats of multiple plies are looped or tucked staggered.

6. A method according to claim 5, wherein the floats are looped or tucked staggered 1×1.

7. A method according to claim 1, wherein the floats of successive courses of the basic knit are looped or tucked staggered.

8. A method according to claim 7, wherein the floats are looped or tucked staggered 1×1.

9. A method of making a knit employing a flat bed machine having front and rear needle beds with active needles, the method including forming a basic knit of at least one ply by knitting a succession of first courses in which a majority of the active needles are used in forming loops and a succession of second courses including floats, wherein each float has a spacing length of at least two active needles, and wherein there is a greater proportion of first courses in a first area of the knit than in a second area of the knit.

10. A method according to claim 9, wherein the knit is made in the first area with an elastic thread.

11. A method according to claim 9, wherein the floats of successive second courses are mutually staggered.

12. A method according to claim 9, wherein the spacing length of the floats varies within the knit.

13. A method according to claim 9, comprising including warp threads in the basic knit to increase longitudinal stability of the basic knit.

14. A method according to claim 9, wherein said one ply is composed of said basic knit and at least one other knit.

15. A method according to claim 9, wherein said one ply is composed of said basic knit and a net knit comprising:

first courses in which a looping thread is sunk at each needle in at least a first needle bed, the looping thread being tucked on the needles of a second needle bed in defined needle spacings, a succession of second courses on said first needle bed including floats, the floats of successive second courses being mutually staggered, third courses in which a looping thread is sunk at each needle in at least the first needle bed, the looping thread being tucked on the needles of said second needle bed in defined needle spacings, and fourth courses in which the tuck is transferred back from the needles of the second needle bed to the first needle bed.

16. A method according to claim 15, wherein the net knit comprises a succession of repetitions of the first, second, third and fourth courses.

17. A method according to claim 15, wherein the net knit is of at least two plies and the method comprises providing a pile thread between the two plies of the net knit and joined alternatingly to the two plies in defined spacings by loop sinking or tucking.

18. A method according to claim 9, wherein said one ply is composed of said basic knit and a net knit and the net knit is provided in the first area of the knit.

19. A method according to claim 9, wherein the basic knit is of at least two plies and the method comprises providing a pile thread between the two plies of the knit and joined alternatingly to the two plies in defined spacings by loop sinking or tucking.

20. A method according to claim 9, wherein the basic knit is of at least two plies and the floats of multiple plies are looped or tucked staggered.

21. A method according to claim 20, wherein the floats are looped or tucked staggered 1×1.

22. A method according to claim 9, wherein the floats of successive courses of the basic knit are looped or tucked staggered.

23. A method according to claim 22, wherein the floats are looped or tucked staggered 1×1.

24. A knit made by a method according to claim 1.

25. A knit according to claim 24, having at least first and second plies and in which the second ply differs from the first ply in number of loops or wales.

26. A knit according to claim 25, wherein the knit has an exposed ply which comprises an intarsia knit for application of a design element.

27. A knit made by a method according to claim 9.

28. A knit according to claim 27, having at least first and second plies and in which the second ply differs from the first ply in number of loops or wales.

29. A knit according to claim 28, wherein the knit has an exposed ply which comprises an intarsia knit for application of a design element.

30. A seat having a frame including spaced struts between which there is tensioned a knit according to claim 24, wherein the knit is a self-supporting seat cover and provides a seating surface or backrest.

31. A seat according to claim 30, wherein the knit consists of a multi-ply structure including a seating ply and a supporting ply, said plies being joined to each other by a pile thread.

32. A seat according to claim 30, wherein the seat cover is fabricated as an elastic hose tensioned about the frame.

33. A seat having a frame including spaced struts between which there is tensioned a knit according to claim 27, wherein the knit is a self-supporting seat cover and provides a seating surface or backrest.

34. A seat according to claim 33, wherein said one ply is composed of said basic knit and a net knit comprising:

first courses in which a looping thread is sunk at each needle in at least a first needle bed, the looping thread being tucked on the needles of a second needle bed in defined needle spacings, a succession of second courses on said first needle bed including floats, the floats of successive second courses being mutually staggered, third courses in which a looping thread is sunk at each needle in at least the first needle bed, the looping thread being tucked on the needles of said second needle bed in defined needle spacings, and fourth courses in which the tuck is transferred back from the needles of the second needle bed to the first needle bed.

35. A seat according to claim 34, wherein the knit forms both the seating surface and the backrest, and wherein the seating surface and an outer portion of the backrest are formed by the basic knit and an inner portion of the backrest is formed by the net knit.

36. A seat according to claim 34, wherein the basic knit and the net knit are fabricated at least partially of shrink-type or elastic-type materials.

37. A seat according to claim 33, wherein the knit consists of a multi-ply structure including a seating ply and a supporting ply, said plies being joined to each other by a pile thread.

38. A seat according to claim 33, wherein the seat cover is fabricated as an elastic hose tensioned about the frame.

* * * * *